United States Patent [19]

Ellis

[11] Patent Number: 5,067,771

[45] Date of Patent: Nov. 26, 1991

[54] STADIUM SEAT APPARATUS

[76] Inventor: Christopher M. Ellis, 7475 Cedar Chase, Apt. 3, Stockton Blvd., Sacramento, Calif. 95823

[21] Appl. No.: 636,184

[22] Filed: Dec. 31, 1990

[51] Int. Cl.[5] ..... A47C 4/54

[52] U.S. Cl. ..... 297/378; 297/180; 297/463; 297/DIG. 3; 5/284

[58] Field of Search ..... 297/378, 183, DIG. 3, 297/180, 463, 190, 421, 284

[56] References Cited

U.S. PATENT DOCUMENTS

| | | | |
|---|---|---|---|
| 3,066,980 | 12/1962 | Clute | 297/252 |
| 3,112,956 | 12/1963 | Schick et al. | 297/DIG. 3 X |
| 4,035,606 | 7/1977 | Browder | 5/421 X |
| 4,162,393 | 7/1979 | Balboni | 5/421 X |
| 4,843,662 | 7/1989 | Handelman | 297/183 X |
| 4,865,379 | 9/1989 | Aoki et al. | 5/421 X |

*Primary Examiner*—Laurie K. Cranmer
*Assistant Examiner*—Milton Nelson, Jr.
*Attorney, Agent, or Firm*—Leon Gilden

[57] ABSTRACT

A cushion stadium seat organization is provided, wherein a plurality of seat frame legs mount a first padded circular seat, with a plurality of backrest frame legs mounting a circular backrest member, wherein the backrest member and seat member are coextensively aligned relative to one another in a second folded interrelationship, with the seat and backrest frame legs pivotally mounted relative to one another. A handle structure is provided at upper terminal ends of the seat and back rest that are aligned for transport and securement of the organization. A modification of the cushion stadium seat includes a heated, selectively inflatable seat chamber, as well as an inflatable cushion backrest chamber.

1 Claim, 4 Drawing Sheets

PRIOR ART

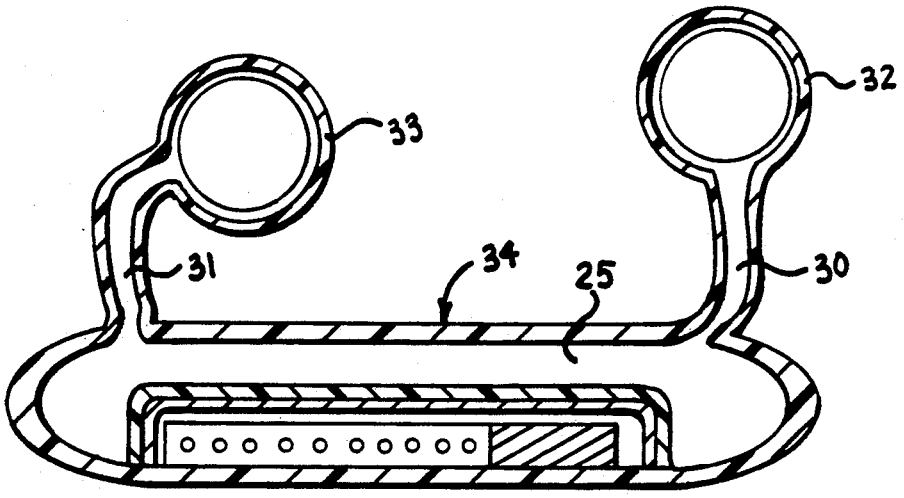
FIG 7
FIG 8
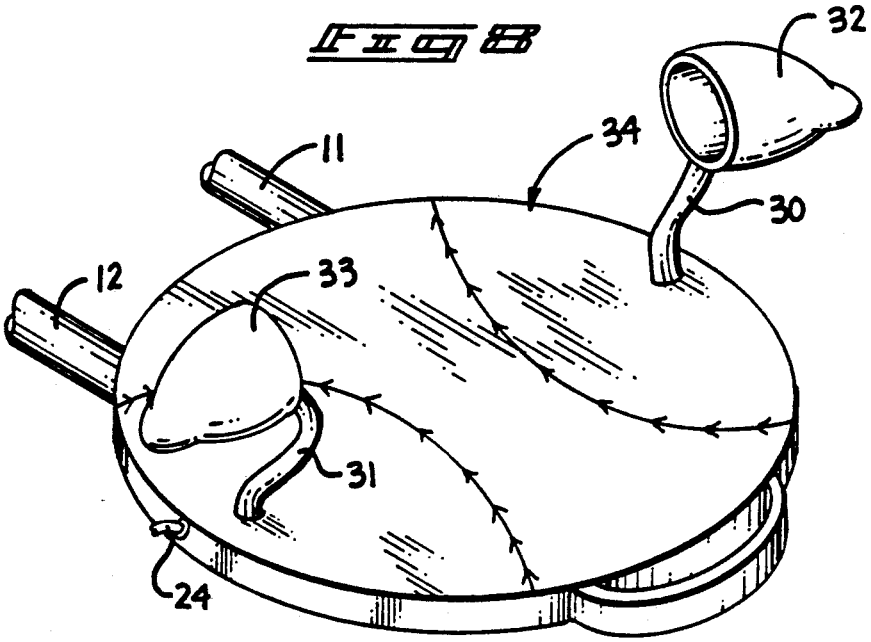

STADIUM SEAT APPARATUS

BACKGROUND OF THE INVENTION

1. Field of the Invention

The field of invention relates to stadium seat structure, and more particularly pertains to a new and improved stadium seat apparatus wherein the same may be readily interfolded during periods of non-use for ease of transport and storage thereof.

2. Description of the Prior Art

Various stadium seat apparatus has been provided in the prior art to provide comfort and convenience to individuals seated in the plank-type seating arrangements typically provided at sporting events. Such structure is found for example in U.S. Pat. No. 3,066,980 to Clute providing a foldable stadium chair formed with a padded seat cooperative with a back rest member.

U.S. Pat. No. 3,026,142 to Holloway sets forth the use of a foldable framework structure utilized with a seat and back rest member.

U.S. Pat. No. 4,611,852 to Filer sets forth a bleacher-type seat structure wherein the seat and backrest are each of a unitary construction and are interfoldable relative to one another for transport.

U.S. Pat. No. 4,079,993 to Pierce sets forth a backrest member that is arranged for mounting on a plank-type stadium seat.

U.S. Pat. No. 4,045,834 to Mason sets forth a further example of a backrest member utilized in a stadium organization.

As such, it may be appreciated that there continues to be a need for a new and improved stadium seat apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of stadium seat apparatus now present in the prior art, the present invention provides a stadium seat apparatus wherein the same is readily interfolded and of symmetrical construction for ease of transport and storage, as well as utilizing optional heating for comfort of the seat apparatus during use. As such, the general purpose of the present invention, which will be described subsequently in greater detail, is to provide a new and improved stadium seat apparatus which has all the advantages of the prior art stadium seat apparatus and none of the disadvantages.

To attain this, the present invention provides a cushion stadium seat organization wherein a plurality of seat frame legs mount a first padded circular seat, with a plurality of backrest frame legs mounting a circular backrest member, wherein the backrest member and seat member are coextensively aligned relative to one another in a second folded interrelationship, with the seat and backrest frame legs pivotally mounted relative to one another. A handle structure is provided at upper terminal ends of the seat and backrest that are aligned for transport and securement of the organization. A modification of the invention includes a heated, selectively inflatable seat chamber, as well as an inflatable cushion backrest chamber.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved stadium seat apparatus which has all the advantages of the prior art stadium seat apparatus and none of the disadvantages.

It is another object of the present invention to provide a new and improved stadium seat apparatus which may be easily and efficiently manufactured and marketed.

It is a further object of the present invention to provide a new and improved stadium seat apparatus which is of a durable and reliable construction.

An even further object of the present invention is to provide a new and improved stadium seat apparatus which is susceptible of a low cost of manufacture with regard to both materials and labor, and Which accordingly is then susceptible of low prices of sale to the consuming public, thereby making such stadium seat apparatus economically available to the buying public.

Still yet another object of the present invention is to provide a new and improved stadium seat apparatus which provides in the apparatuses and methods of the prior art some of the advantages thereof, while simultaneously overcoming some of the disadvantages normally associated therewith.

Still another object of the present invention is to provide a new and improved stadium seat apparatus wherein the same provides for symmetrical alignment of a backrest and seat structure for ease of transport and storage of the organization during periods of non-use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is an orthographic cross-sectional illustration of a further modified seat member utilized by the instant invention.

FIG. 8 is an isometric illustration of the further modified seat member.

DESCRIPTION OF THE PREFERRED EMBODIMENT

Figure 1:
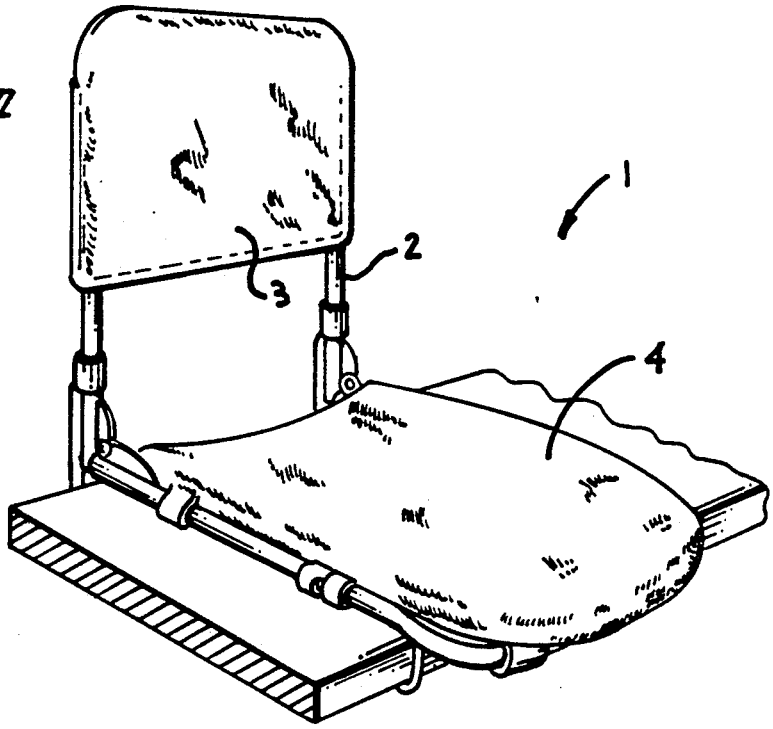
FIG. 1 is an isometric illustration of a prior art stadium seat apparatus.

With reference now to the drawings, and in particular to FIGS. 1 to 8 thereof, a new and improved stadium seat apparatus embodying the principles and concepts of the present invention and generally designated by the reference numerals 10 and 10*a* will be described.

Figure 2:
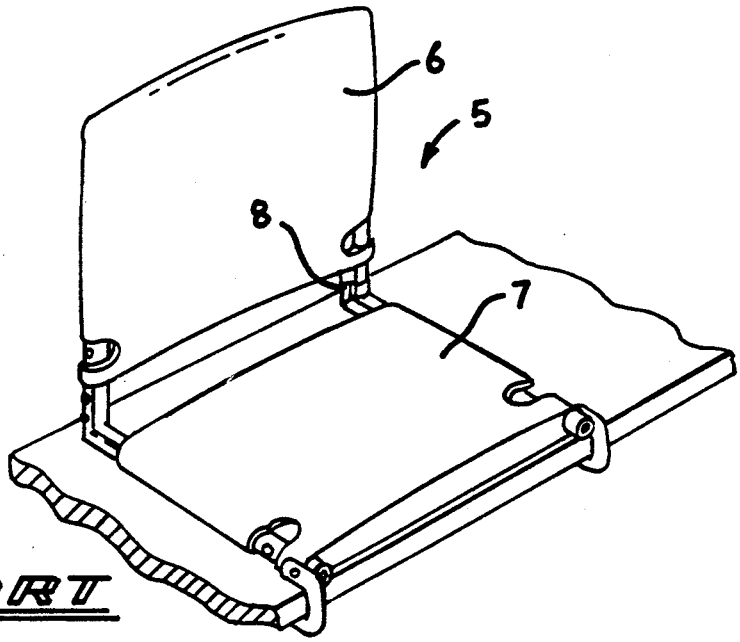
PRIOR ART FIG 2
FIG. 2 is an isometric illustration of a further example of stadium seat apparatus.

FIG. 1 illustrates a prior art stadium seat structure 1, wherein an interfoldable framework 2 mounts a backrest 3 and a padded seat member 4, as set forth in U.S. Pat. No. 3,066,980. FIG. 2 is a further stadium seat structure 5 utilizing interfoldable and pivotally mounted frame legs pivotally joined at junctions 8 to interfold a backrest 6 and a seat member 7, in a manner as set forth in U.S. Pat. No. 3,026,142.

Figure 3:
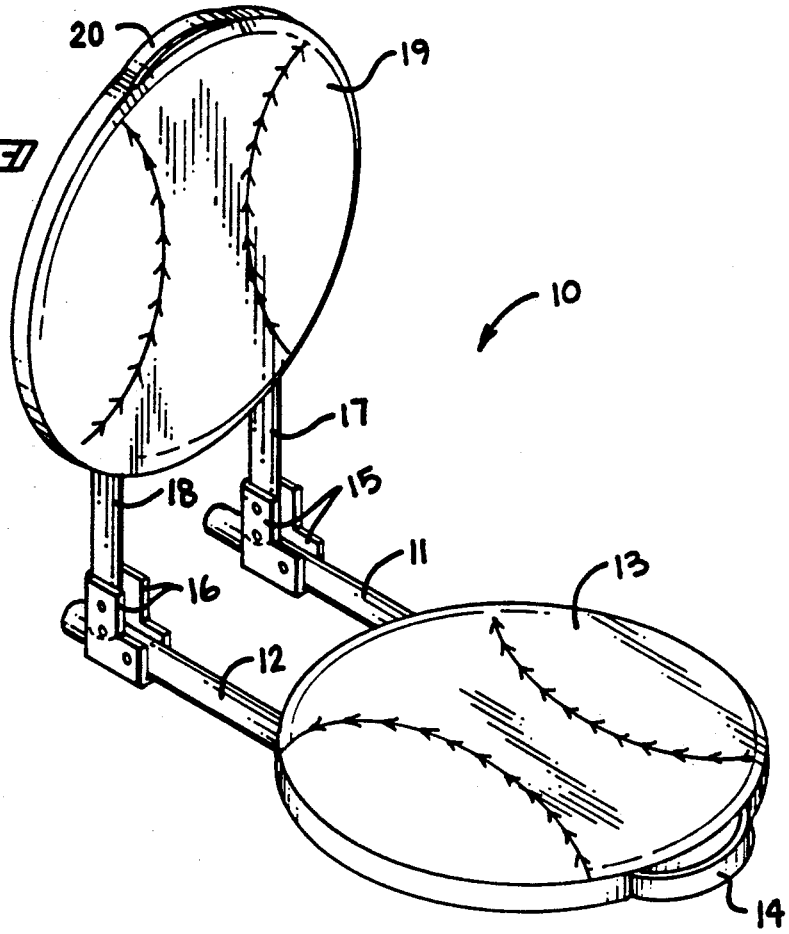
FIG. 3 is an isometric illustration of the instant invention in a first opened configuration.
Figure 4:
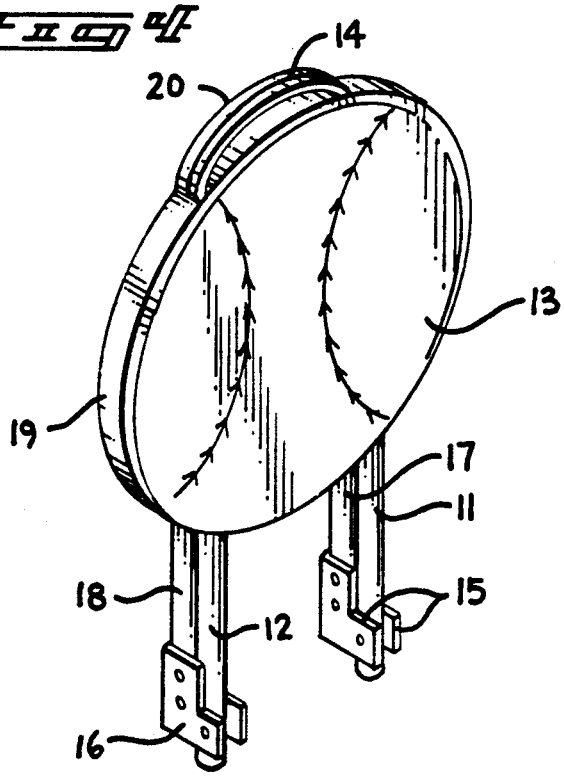
FIG. 4 is an isometric illustration of the instant invention in a second folded configuration.

More specifically, the stadium seat apparatus 10 of the instant invention essentially comprises a respective right and left seat frame leg 11 and 12 coextensively aligned relative to one another in a parallel relationship mounting a padded seat member 13 thereon. The padded seat member 13 is of a predetermined cylindrical configuration. A first handle 14 is mounted to the upper side wall surface of the padded seat member 13. A respective right and left pair of "L" shaped hinge plates 15 and 16 are pivotally mounted adjacent lower terminal ends of the right and left seat frame legs 11 and 12. Respective right and left back rest frame legs 17 and 18 are fixedly mounted relative to the hinge plates and fixedly secure a padded backrest 19 of an equal predetermined cylindrical configuration to the right and left backrest frame legs 17 and 18. A second handle 20 is mounted to an upper cylindrical edge of the padded backrest member 19. In the second position, as illustrated in FIG. 4, wherein the organization is in a collapsed configuration from the first position, as illustrated in FIG. 3, wherein the backrest 19 and the seat member 13 are orthogonally oriented relative to one another, the seat members 13 and 19 are coaxially aligned in the second position, with the handles 14 and 20 aligned and coextensive relative to one another, whereupon securement of the handles 14 and 19 ensures securement of the seat member 13 and the backrest 19 in the second collapsed configuration.

Figure 5:
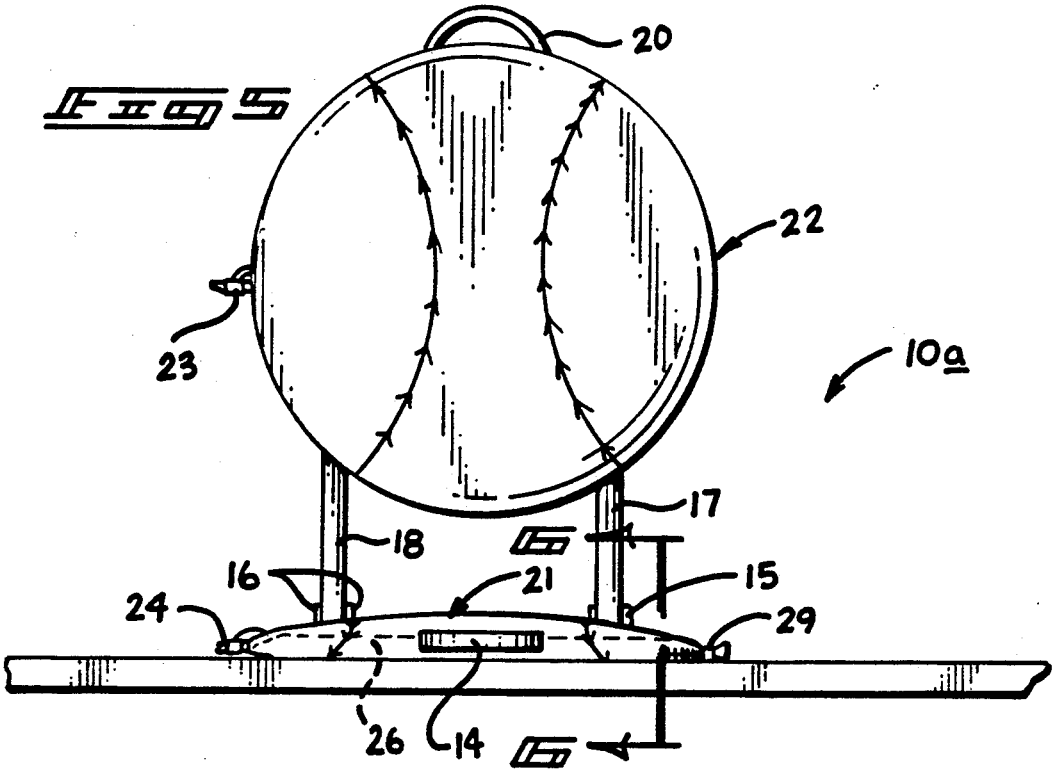
FIG. 5 is an orthographic frontal view, taken in elevation, of a modification of the instant invention utilizing pneumatic chambers for the backrest and seat structure.
Figure 6:
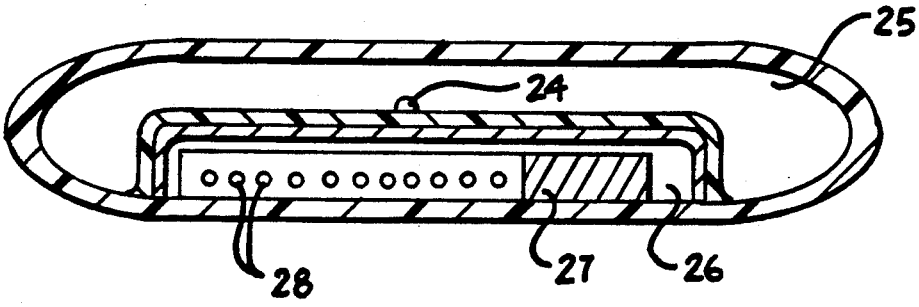
FIG. 6 is an orthographic view, taken along the lines 6—6 of FIG. 5 in the direction indicated arrows.

FIG. 5 illustrates the use of a modified seat member 21 in cooperation with a modified backrest 22. A first inflation valve 23 is directed into a pneumatic chamber that is coextensive with the backrest member 22 to provide selective inflation thereof for selective firmness of the backrest and comfort associated therewith. A second inflation valve 24 is in communication with a seat member pneumatic chamber 25 of a generally "C" shaped, cross-sectional configuration that is coextensively directed through the seat member that overlies the heating chamber 26. The heating chamber 26 is accessed through an access zipper 29 in communication with the heating chamber 26 to permit positioning of the heating member therewithin utilizing a plurality of heating coils 28 cooperative through a battery 27 to effect heating of the chamber 26. The heating coils 28 are of conventional electrical resistance type in cooperation with a battery structure In this manner, the pneumatic chamber 25 is heated. FIGS. 7 and 8 illustrate a further modified seat member 34, wherein the pneumatic chamber 25 includes a right and left heating conduit 30 and 31 in communication with the pneumatic chamber 25 to direct heated air in pneumatic chamber 25 into a respective right and left socket 32 and 33 permitting an individual seated upon the further modified seat member 34 to provide warming of the hands when positioned within the sockets. The sockets are defined by an entrance opening directed into a conically tapered configuration to accommodate an individual's hands positioned within each socket.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling Within the scope of the invention.

What is claimed as being new and desired to be protected by Letters Patent of the United States is as follows:

1. A stadium seat apparatus comprising, in combination, a right seat frame leg and a left seat frame leg, wherein the right and left seat frame legs are coextensive and parallel relative to one another, and a right backrest frame leg and a left backrest frame leg, wherein the right backrest frame leg is pivotally mounted to the right seat frame leg, and the left backrest frame leg is mounted to the left seat frame leg, and a padded seat member of a predetermined cylindrical configuration mounted to the right and left seat frame legs, and a padded backrest defined by a further configuration equal to the predetermined cylindrical configuration mounted to the right and left backrest frame legs, and a first handle mounted to a side wall of the padded seat member, and a second handle mounted to a further side wall defined by the padded backrest wherein the padded seat member and the padded backrest are orthogonally aligned relative to one another in a first position, and wherein the padded seat member and the padded backrest are coaxially aligned and coextensively arranged relative to one another in a second collapsed position, and the first handle and the second handle are coextensively aligned relative to one another in the second position and wherein the padded backrest defines a pneumatic chamber and includes a first inflation valve mounted to the padded backrest to effect selective inflation of the pneumatic chamber, and a further pneumatic chamber defined by the padded seat member and the padded seat member includes a second inflation valve in communication with the further pneumatic chamber to effect selective inflation of the further pneumatic chamber, and wherein the padded seat member includes a heating chamber diametrically aligned with the padded seat member and coextensive therewith underlying the further pneumatic chamber, wherein the further pneumatic chamber is of a generally "C" shaped cross-sectional configuration, and the heating chamber includes a heating means therewithin including a series of parallel heating coils cooperative with a battery member to effect heating of the heating member and the further pneumatic chamber, and wherein the further pneumatic chamber includes a right and left flexible heating conduit extending above the padded seat member, wherein the right and left flexible heating conduit each include a respective right and left socket, each socket includes an entrance opening directed into a conically configured cavity to direct heated air from the further pneumatic chamber into each socket.

* * * * *